US007673677B2

(12) United States Patent
King et al.

(10) Patent No.: US 7,673,677 B2
(45) Date of Patent: Mar. 9, 2010

(54) REUSABLE BALL SEAT HAVING BALL SUPPORT MEMBER

(75) Inventors: James G. King, Kingwood, TX (US); David B. Ruddock, Pearland, TX (US)

(73) Assignee: Baker Hughes Incorporated, Houston, TX (US)

( * ) Notice: Subject to any disclaimer, the term of this patent is extended or adjusted under 35 U.S.C. 154(b) by 265 days.

(21) Appl. No.: 11/891,714

(22) Filed: Aug. 13, 2007

(65) Prior Publication Data

US 2009/0044955 A1 Feb. 19, 2009

(51) Int. Cl.
*E21B 33/12* (2006.01)
*E21B 34/14* (2006.01)
*E21B 34/00* (2006.01)

(52) U.S. Cl. ..... 166/193; 166/195; 166/318; 166/326

(58) Field of Classification Search ..... 166/192, 166/193, 194, 195, 318, 326
See application file for complete search history.

(56) References Cited

U.S. PATENT DOCUMENTS 1,883,071 A 10/1932 Stone
2,769,454 A 11/1956 Bletcher et al.
2,822,757 A * 2/1958 Coberly ..... 166/53
2,973,006 A 2/1961 Nelson
3,007,527 A 11/1961 Nelson
3,013,612 A 12/1961 Angel
3,211,232 A 10/1965 Grimmer
3,510,103 A 5/1970 Carsello
3,566,964 A 3/1971 Livingston (Continued)

FOREIGN PATENT DOCUMENTS

GB 2281924 A 3/1995

(Continued)

OTHER PUBLICATIONS

Notification of Transmittal of the International Search Report and the Written Opinion of the International Searching Authority, Or the Declaration, Jan. 19, 2009, pp. 1-4, PCT/US2008/072470, Korean Intellectual Property Office.

(Continued)

*Primary Examiner*—David J Bagnell
*Assistant Examiner*—Brad Harcourt
(74) *Attorney, Agent, or Firm*—Greenberg Traurig LLP; Anthony F. Matheny

(57) ABSTRACT

Apparatuses for restricting fluid flow through a well conduit comprise a housing having a longitudinal bore and a reusable seat disposed within the bore. The seat comprises a slidable element, a fixed element, a plug element support member, a seat inner diameter, and a return member to urge the slidable element toward the run-in position. The plug element support member has a retracted position when the seat is in the run-in position and an extended position when the seat is in the set position. A plug element adapted to be disposed into the bore and landed on the seat to restrict fluid flow through the bore and the well conduit is used to move the plug element support member from the retracted position to the extended position, thereby providing support to the plug element landed on the seat.

22 Claims, 5 Drawing Sheets

U.S. PATENT DOCUMENTS

| | | | | |
|---|---|---|---|---|
| 3,667,505 | A | 6/1972 | Radig | |
| 3,727,635 | A | 4/1973 | Todd | |
| 3,901,315 | A | 8/1975 | Parker et al. | |
| 4,160,478 | A | 7/1979 | Calhoun et al. | |
| 4,291,722 | A | 9/1981 | Churchman | |
| 4,390,065 | A | 6/1983 | Richardson | |
| 4,448,216 | A | 5/1984 | Speegle et al. | |
| 4,478,279 | A | 10/1984 | Puntar et al. | |
| 4,510,994 | A | 4/1985 | Pringle | |
| 4,537,383 | A | 8/1985 | Fredd | |
| 4,576,234 | A | 3/1986 | Upchurch | |
| 4,583,593 | A | 4/1986 | Zunkel et al. | |
| 4,669,538 | A | 6/1987 | Szarka | |
| 4,826,135 | A | 5/1989 | Mielke | |
| 5,056,599 | A | 10/1991 | Comeaux et al. | |
| 5,244,044 | A | 9/1993 | Henderson | |
| 5,297,580 | A | 3/1994 | Thurman | |
| 5,704,393 | A | 1/1998 | Connell et al. | |
| 5,762,142 | A | 6/1998 | Connell et al. | |
| 5,813,483 | A | 9/1998 | Latham et al. | |
| 5,960,881 | A | 10/1999 | Allamon et al. | |
| 6,050,340 | A | 4/2000 | Scott | |
| 6,155,350 | A | 12/2000 | Melenyzer | |
| 6,293,517 | B1 | 9/2001 | Cunningham | |
| 6,530,574 | B1 | 3/2003 | Bailey et al. | |
| 6,547,007 | B2 | 4/2003 | Szarka et al. | |
| 6,634,428 | B2 | 10/2003 | Krauss et al. | |
| 6,666,273 | B2 | 12/2003 | Laurel | |
| 6,668,933 | B2 | 12/2003 | Kent | |
| 6,834,726 | B2 | 12/2004 | Giroux et al. | |
| 6,866,100 | B2 | 3/2005 | Gudmestad et al. | |
| 6,896,049 | B2 | 5/2005 | Moyes | |
| 7,150,326 | B2 | 12/2006 | Bishop et al. | |
| 7,503,392 | B2 | 3/2009 | King et al. | |
| 2005/0061372 | A1 | 3/2005 | McGrath et al. | |
| 2005/0126638 | A1 | 6/2005 | Gilbert | |
| 2005/0205264 | A1 | 9/2005 | Starr et al. | |
| 2006/0175092 | A1 | 8/2006 | Mashburn | |
| 2006/0213670 | A1 * | 9/2006 | Bishop et al. | 166/386 |
| 2006/0243455 | A1 | 11/2006 | Telfer et al. | |
| 2007/0023087 | A1 | 2/2007 | Krebs et al. | |
| 2008/0066924 | A1 * | 3/2008 | Xu | 166/376 |
| 2008/0217025 | A1 | 9/2008 | Ruddock et al. | |
| 2009/0044946 | A1 | 2/2009 | Schasteen et al. | |
| 2009/0044948 | A1 | 2/2009 | Avant et al. | |

FOREIGN PATENT DOCUMENTS

| | | |
|---|---|---|
| WO | WO 00/15943 | 3/2000 |

OTHER PUBLICATIONS

International Search Report, Jan. 19, 2009, pp. 1-3, PCT/US2008/072470, Korean Intellectual Property Office.
Written Opinion of the International Searching Authority, Jan. 19, 2009, pp. 1-3, PCT/US2008/072470, Korean Intellectual Property Office.
Notification of Transmittal of the International Search Report and the Written Opinion of the International Searching Authority, Or the Declaration, Feb. 11, 2009, pp. 1-4, PCT/US2008/072732, Korean Intellectual Property Office.
International Search Report, Feb. 11, 2009, pp. 1-3, PCT/US2008/072732, Korean Intellectual Property Office.
Written Opinion of the International Searching Authority, Feb. 11, 2009, pp. 1-3, PCT/US2008/072732, Korean Intellectual Property Office.
International Search Report, Feb. 11, 2009, pp. 1-3, PCT/US2008/072734, Korean Intellectual Property Office.
Written Opinion of the International Searching Authority, Feb. 11, 2009, pp. 1-4, PCT/US2008/072734, Korean Intellectual Property Office.
International Search Report, Feb. 11, 2009, pp. 1-3, PCT/US2008/072735, Korean Intellectual Property Office.
Written Opinion of the International Searching Authority, Feb. 11, 2009, pp. 1-4, PCT/US2008/072735, Korean Intellectual Property Office.
Office Action dated Jul. 16, 2008 in U.S. Appl. No. 11/891,713 U.S. Patent and Trademark Office, U.S.A.
StageFRAC Maximize Reservoir Drainage, 2007, pp. 1-2, Schlumberger, U.S.A.
Brad Musgrove, Multi-Layer Fracturing Solution Treat and Produce Completions, Nov. 12, 2007, pp. 1-23, Schlumberger, U.S.A.
G.L. Rytlewski, A Study of Fracture Initiation Pressures in Cemented Cased-Hole Wells Without Perforations, May 15, 2006, pp. 1-10, SPE 100572, Society of Petroleum Engineers, U.S.A.
Response to Office Action dated Oct. 15, 2008, in U.S. Appl. No. 11/891,713, U.S. Patent and Trademark Office, U.S.A.
Notice of Allowance & Fees Due and Notice of Allowability dated Jan. 5, 2009, in U.S. Appl. No. 11/891,713, U.S. Patent and Trademark Office, U.S.A.
Office Action dated Apr. 9, 2009, in U.S. Appl. No. 11/891,715, U.S. Patent and Trademark Office, U.S.A.
Response to Restriction Requirement dated Apr. 22, 2009, in U.S. Appl. No. 11/891,715, U.S. Patent and Trademark Office, U.S.A.
Office Action dated Jun. 19, 2009, in U.S. Appl. No. 11/891,715, U.S. Patent and Trademark Office, U.S.A.
Office Action dated Jul. 6, 2009, in U.S. Appl. No. 12/317,647, U.S. Patent and Trademark Office, U.S.A.
Office Action dated Jul. 7, 2009, in U.S. Appl. No. 11/891,706, U.S. Patent and Trademark Office, U.S.A.
Summary of Examiner Interview dated Aug. 6, 2009, in U.S. Appl. No. 12/317,647, U.S. Patent and Trademark Office, U.S.A.
Summary of Examiner Interview dated Aug. 7, 2009, in U.S. Appl. No. 11/891,706, U.S. Patent and Trademark Office, U.S.A.
Amendment in Response to Office Action dated Aug. 10, 2009, in U.S. Appl. No. 12/317,647, U.S. Patent and Trademark Office, U.S.A.
Amendment in Response to Office Action dated Aug. 10, 2009, in U.S. Appl. No. 11/891,706, U.S. Patent and Trademark Office, U.S.A.
Amendment in Response to Office Action dated Aug. 10, 2009, in U.S. Appl. No. 11/891,715, U.S. Patent and Trademark Office, U.S.A.

* cited by examiner

REUSABLE BALL SEAT HAVING BALL SUPPORT MEMBER

BACKGROUND

1. Field of Invention

The present invention is directed to ball seats for use in oil and gas wells and, in particular, to reusable ball seats having a ball seat support member that provides support to the ball in addition to the support provided by the seat and a return member for returning the ball seat to its run-in position after being actuated by the ball.

2. Description of Art

Ball seats are generally known in the art. For example, typical ball seats have a bore or passageway that is restricted by a seat. The ball or drop plug is disposed on the seat, preventing or restricting fluid from flowing through the bore of the ball seat and, thus, isolating the tubing or conduit section in which the ball seat is disposed. As the fluid pressure above the ball or drop plug builds up, the conduit can be pressurized for tubing testing or actuating a tool connected to the ball seat such as setting a packer. Ball seats are also used in cased hole completions, liner hangers, flow diverters, frac systems, and flow control equipment and systems.

Although the terms "ball seat" and "ball" are used herein, it is to be understood that a drop plug or other shaped plugging device or element may be used with the "ball seats" disclosed and discussed herein. For simplicity it is to be understood that the term "ball" includes and encompasses all shapes and sizes of plugs, balls, or drop plugs unless the specific shape or design of the "ball" is expressly discussed.

As mentioned above, all seats allow a ball to land and make a partial or complete seal between the seat and the ball during pressurization. The contact area between the ball and the inner diameter of the seat provides the seal surface. Generally, the total contact area or bearing surface between the ball and the seat is determined by the outer diameter of the ball and the inner diameter of seat. The outer diameter of the contact area is determined by the largest diameter ball that can be transported down the conduit. The inner diameter of the seat is determined by the allowable contact stress the ball can exert against the contact area and/or the required inner diameter to allow preceding passage of plug elements or tools, and/or subsequent passage of tools after the plug element is removed, through the inner diameter of the seat.

The seat is usually made out of a metal that can withstand high contact forces due to its high yield strength. The ball, however, is typically formed out of a plastic material that has limited compressive strength. Further, the contact area between the ball and seat is typically minimized to maximize the seat inner diameter for the preceding passage of balls, plug elements, or other downhole tools. Therefore, as the ball size becomes greater, the contact stresses typically become higher due to the increasing ratio of the cross-section of the ball exposed to pressure compared to the cross-section of the ball in contact with the seat. This higher contact pressure has a propensity to cause the plastic balls to fail due to greater contact stresses.

The amount of contact pressure a particular ball seat can safely endure is a direct function of the ball outer diameter, seat inner diameter, applied tubing pressure, and ball strength. Because of limited ball strength as discussed above, the seat inner diameter is typically reduced to increase the contact area (to decrease contact stress). The reduced seat inner diameter forces the ball previously disposed through the seat inner diameter to have a smaller outer diameter to pass through this seat inner diameter. This reduction in outer diameter of previous balls continues throughout the length of conduit until ball seats can no longer be utilized. Therefore, a string of conduit is limited as to the number of balls (and, thus ball seats) that can be used which reduces the number of actuations that can be performed through a given string of conduit.

SUMMARY OF INVENTION

Broadly, ball seats having a housing, a seat, a ball support member, and a plug element such as a ball are disclosed. Typically, the ball is landed and the conduit is pressurized to a predetermined pressure. Upon pressurization of the conduit so that the ball is pushed into the seat, the seat forces a plug element support member to extend laterally, e.g., inwardly from its retracted position into the seat bore to reduce the seat inner diameter as the ball seat bore is being pressurized. In other words, the force of the ball into the seat by the pressure in the tubing causes the seat to move the plug element support member inward into the bore of the ball seat from its retracted position toward the centerline (or axis) of the bore of the ball seat and into its extended positions, thus either making contact with the previously unsupported area of the ball or otherwise distributing the force acting on the ball over a larger surface area so that the ball and seat can withstand higher pressures and/or restrict movement of the ball through the seat inner diameter as the pressure begins to deform and extrude the ball through the seat.

By being moved laterally, e.g., inwardly toward the axis of the ball seat bore, the plug element support member provides support for the ball because the resulting force against the ball caused by pressurization of the ball against the seat is spread out between the existing seat contact area and the additional force distribution area provided by the extended plug element support member. The applied pressure to the plug element support member, therefore, decreases the likelihood that the force on the ball will push the ball through the seat or that the seat will otherwise fail.

Due to the plug element support member providing additional support to the ball, the ball seats disclosed herein provide a plugging method where higher pressure can be exerted onto a seat by a lower strength ball without exceeding the ball's bearing or load strength. Further, the contact pressure resulting from having additional force distribution area provided by the plug element support members can be effectively reduced without affecting the sealability of the ball. Thus, more sizes of balls in closer increments can be utilized in various applications such as in frac ball systems. Additionally, more balls can be used because the seat inner diameter of subsequent seats can be larger due to the seat inner diameter of the seats of each ball seat in the conduit being larger. This allows more balls to go through the conduit because the seat inner diameters are larger throughout the length of conduit. Because more balls or plug elements can travel through the frac ball systems, more producible zones can be isolated by a single frac ball system.

Therefore, additional force distribution area is provided by the plug element support member that allows a greater pressure to be exerted onto the ball while keeping the original seat inner diameter the same or, alternatively, allows a larger seat inner diameter with the current pressures. The additional force distribution area also allows the contact pressure resulting from the tubing pressure onto the ball to be distributed to the standard seat contact area between the seat and the ball and the new areas provided by the plug element support member and the ball.

Furthermore, the ball seats include one or more return member, such as a coiled spring, belleville spring (also known as belleville washers), a spiral spring, or an elastomeric material, that urges the ball seat against the ball, i.e., against the fluid pressure forcing the ball into the seat. This return member can be upwardly biased so that after fluid pressurization above the ball has performed its intended function, e.g., actuation of a downhole tool, and the fluid pressurization is decreased, the return member facilitates movement of the ball seat from the set position to the run-in position. In so doing, the ball is released and allowed to be recovered, such as by floating to the surface of the well, and the bore of the ball seat is moved towards its original run-in diameter. Accordingly, the ball seat can be reused at a later date to restrict flow through the well conduit.

In one embodiment, an apparatus for restricting flow through a well conduit is disclosed. The apparatus comprises a housing having a longitudinal bore having an axis and a seat disposed within the bore, the seat comprising a slidable element in sliding engagement with an inner wall surface of the housing, the slidable element having a run-in position and a set position, a fixed element secured to the housing, the fixed element being operatively associated with the slidable element, a plug element support member operatively associated with the slidable element and the fixed element, the plug element support member having a retracted position defining a first seat inner diameter and an extended position defining a second seat inner diameter, the first seat inner diameter being greater than the second seat inner diameter, and a return member operatively associated with the slidable element for urging the slidable element toward the run-in position, wherein the plug element support member is in the retracted position when the seat is in the run-in position and the plug element support member is in the extended position when the seat is in the set position, the plug element support member restricting the bore when in the extended position; and a plug element adapted to be disposed into the bore and landed on the seat to restrict fluid flow through the bore and the well conduit and to cause the plug element support member to move from the retracted position to the extended position thereby restricting the bore and providing support to the plug element landed on the seat.

A further feature of the apparatus is that the plug element support member may be a deformable element. Another feature of the apparatus is that the slidable portion may be connected to the fixed portion by a seat inner wall, the seat inner wall partially defining a chamber. An additional feature of the apparatus is that the deformable element may be disposed within the chamber. Still another further feature of the apparatus is that the plug element support member may be a collet. A further feature of the apparatus is that the collet may include a plurality of collet fingers, each collet finger having a collet profile surface reciprocal in shape to a slidable element profile surface disposed on the slidable element. Another feature of the apparatus is that the plug element support member may be a spiral spring. An additional feature of the apparatus is that the seat may comprise a plug element engagement surface, the plug element engagement surface having a deformable layer capable of forming a shape reciprocal to a shape of the plug element. Still another feature of the apparatus is that the plug element support member may be a bellows. A further feature of the apparatus is that the plug element support member may be a belleville spring. Another feature of the apparatus is that the plug element support member and the return member may be the same belleville spring.

In another embodiment of the apparatus for restricting flow through a well conduit, the apparatus has a run-in position and a set position and comprises a housing having a longitudinal bore with a seat engagement surface disposed on an inner wall surface of the bore; a seat comprising a slidable element, the slidable element in sliding engagement with the seat engagement surface and having a first position when the apparatus is in the run-in position and a second position when the apparatus is in the set position, a fixed element secured to the housing, the fixed element being operatively associated with the slidable element, and a plug element support member operatively associated with the slidable element and the fixed element, the plug element support member having a retracted position when the apparatus is in the run-in position and an extended position when the apparatus is in the set position, the retracted position defining a first plug element support member cross-sectional area and the extended position defining a second plug element support member cross-sectional area, the second plug element support member cross-sectional area being greater than the first plug element support member cross-sectional area; and a plug element adapted to be disposed into the bore and landed on the seat to restrict fluid flow through the bore and the well conduit and to cause the plug element support member to move from the retracted position to the extended position thereby defining the second plug element support member cross-sectional area and to provide support to the plug element landed on the seat, wherein the plug element support member extends laterally in the extended position to define the second plug element support member cross-sectional area and to distribute across the second plug element support member cross-sectional area a pressure forcing the plug element into the seat.

A feature of the apparatus is that the plug element support member may be a deformable element, a collet, a spiral spring, a bellows, or a belleville spring.

In another embodiment, a method of temporarily restricting a well conduit is disclosed. The method may comprise the steps of: (a) providing a seat disposed within a housing having a longitudinal bore, the seat comprising a slidable element, the slidable element in sliding engagement with an inner wall surface of the housing and having a first position and a second position when the apparatus is in the set position, a fixed element secured to the housing, the fixed element being operatively associated with the slidable element, a plug element support member operatively associated with the slidable element and the fixed element, the plug element support member having a retracted position when the slidable element is in the first position and an extended position when the slidable element is in the second position, and a return member operatively associated with the slidable element for urging the slidable element toward the first position; (b) lowering the seat on a string of conduit into a wellbore of a well; (c) restricting the bore and well conduit by inserting a plug element into the conduit and landing the plug element on the slidable element; (d) moving the slidable element from the first position to the second position by exerting a force on the slidable element; (e) moving the plug element support member from a retracted position to an extended position thereby distributing the force exerted on the slidable element to the plug element support member; (f) pumping fluid into the conduit forcing the plug element into the seat and energizing the return member; (g) reducing the pumping of fluid into the conduit to allow the return member to urge the slidable element from the second position to the first position; (h) removing the plug element from the slidable element; and (i) moving the slidable element toward the first position and the plug element support member toward the retracted position. In one embodiment, the slidable element is moved back to the first position. In other embodiments, the slidable element is not moved all the way back to the first position, but instead is moved toward the first position sufficiently to allow subsequently passage of other plug elements or downhole tools through the seat inner diameter.

A further feature of the method is that steps (c)-(f) may be repeated. Another feature of the method is that a downhole tool may be actuated as a result of pumping fluid into the conduit forcing the plug element into the seat and energizing the return member.

While the invention will be described in connection with the preferred embodiments, it will be understood that it is not intended to limit the invention to that embodiment. On the contrary, it is intended to cover all alternatives, modifications, and equivalents, as may be included within the spirit and scope of the invention as defined by the appended claims.

DETAILED DESCRIPTION OF INVENTION

Figure 1:
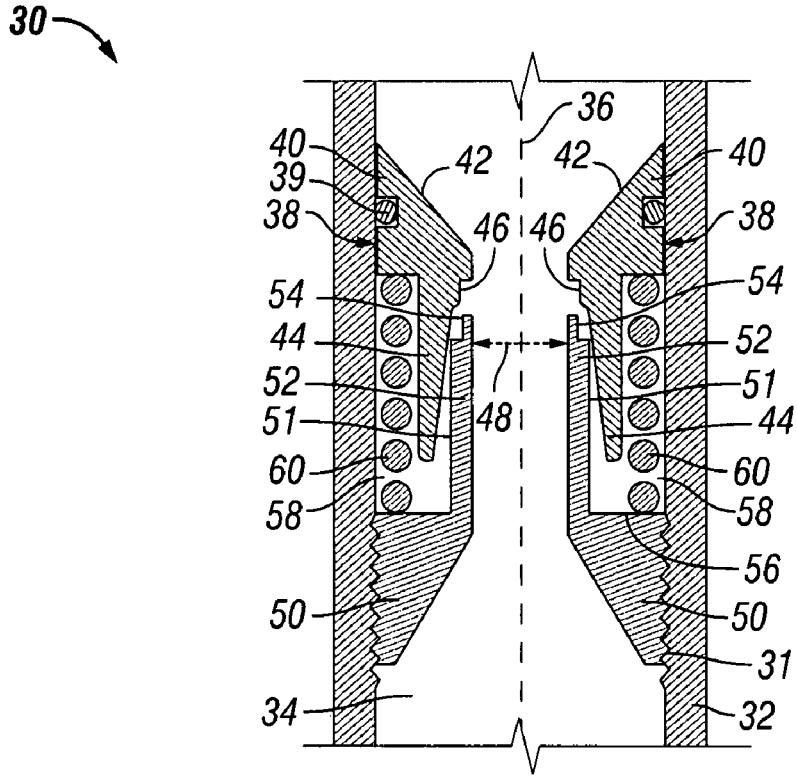
FIG. 1 is a cross-sectional view of a specific embodiment of a ball seat disclosed herein shown in the run-in position.
Figure 2:
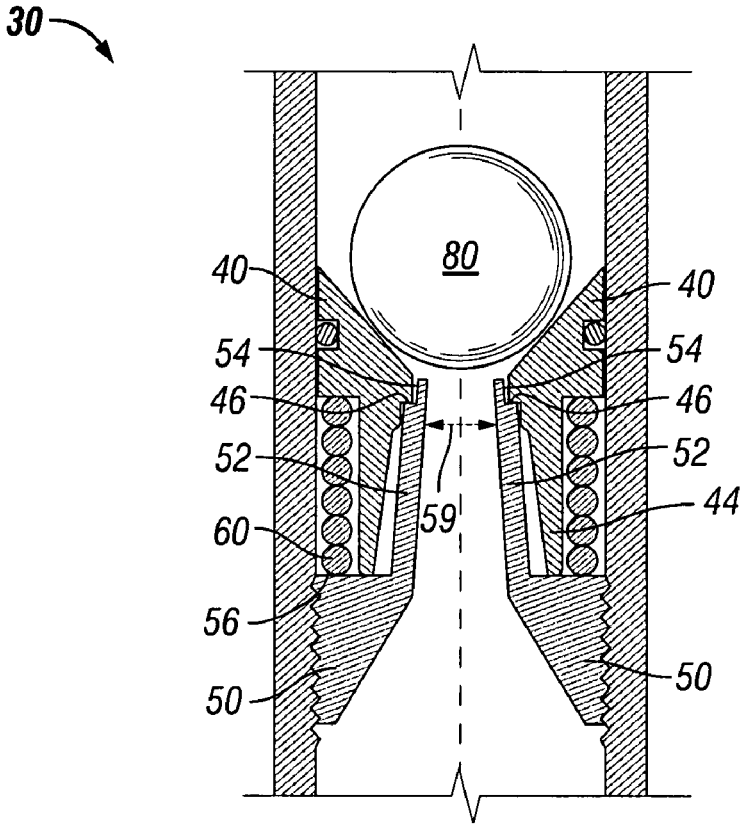
FIG. 2 is a partial cross-sectional view of the ball seat shown in FIG. 1 shown in the actuated or set position.

Referring now to FIGS. 1-2, in one embodiment, ball seat 30 includes a sub or housing 32 having bore 34 defined by an inner wall surface and having axis 36. Attachment members such as threads (not shown) can be disposed along the outer diameter of housing 32 or along the inner wall surface of bore 34 at the upper and lower ends of housing 32 for securing ball seat 30 into a string of conduit, such as drill pipe or tubing.

Bore 34 includes seat 38 for receiving plug element 80, shown as a ball in FIG. 2. Seat 38 includes slidable element 40 and fixed element 50. Slidable element 40 includes a housing engagement surface in sliding engagement with the inner wall surface of housing 32 (also referred to herein as a seat engagement surface) so that slidable element 40, and thus, seat 38, has a first position (FIG. 1) and a second position (FIG. 2). In one embodiment, dynamic seals 39 assist in sliding engagement of slidable element 40 with the inner wall surface of housing 32.

Slidable element 40 also includes plug element engagement surface 42 for receiving plug element 80. Plug element engagement surface 42 can be shaped to form an engagement surface with plug element 80 that is reciprocal in shape to the shape of the plug element 80 (shown in FIG. 2 as a ball). Thus, in this embodiment, plug element 80 is spherically-shaped and plug element engagement surface 42 includes an arc shape (not shown). As mentioned above, however, although plug element 80 is shown as a ball in FIG. 2, it is to be understood that plug element 80 may be a drop plug, dart, or any other plug element known to persons of ordinary skill in the art.

Slidable element 40 further includes stop member 44 having profile surface 46 along the inner diameter wall surface of slidable element 40. As discussed in greater detail below, profile surface 46 is shaped to receive a portion of fixed element 50 when seat 38 is in its set position (FIG. 2). In the embodiment shown in FIGS. 1-2, profile surface 46 is "L" shaped.

Fixed element 50 is secured to the inner wall surface of bore 34 by attachment members such as through threads 31 and includes one or more plug element support members 51. In the embodiment shown in FIGS. 1-2, plug element support member 51 is a collet having a plurality of collet fingers 52. The tips of collet fingers 52 include profile surfaces 54 that are at least partially reciprocal to profile surface 46 on slidable element 40. In the embodiment shown in FIGS. 1-2, profile surfaces 54 are "L" shaped. Fixed element 50 also includes retainer wall surface 56 for engaging with stop member 44 of slidable element 40.

Figure 7:
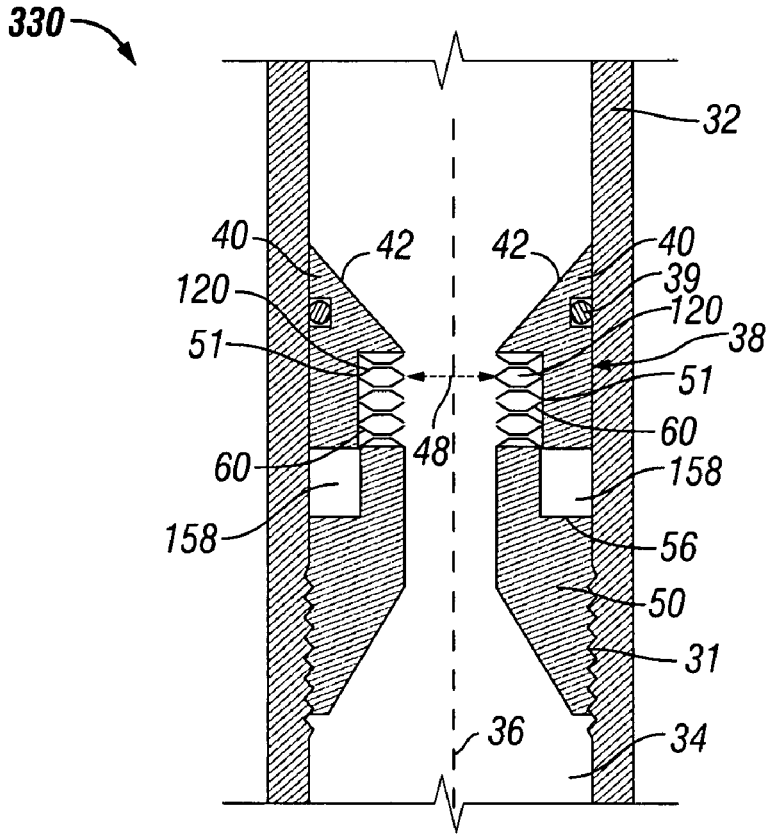
FIG. 7 is a cross-sectional view of a further specific embodiment of a ball seat disclosed herein shown in the run-in position.
Figure 8:
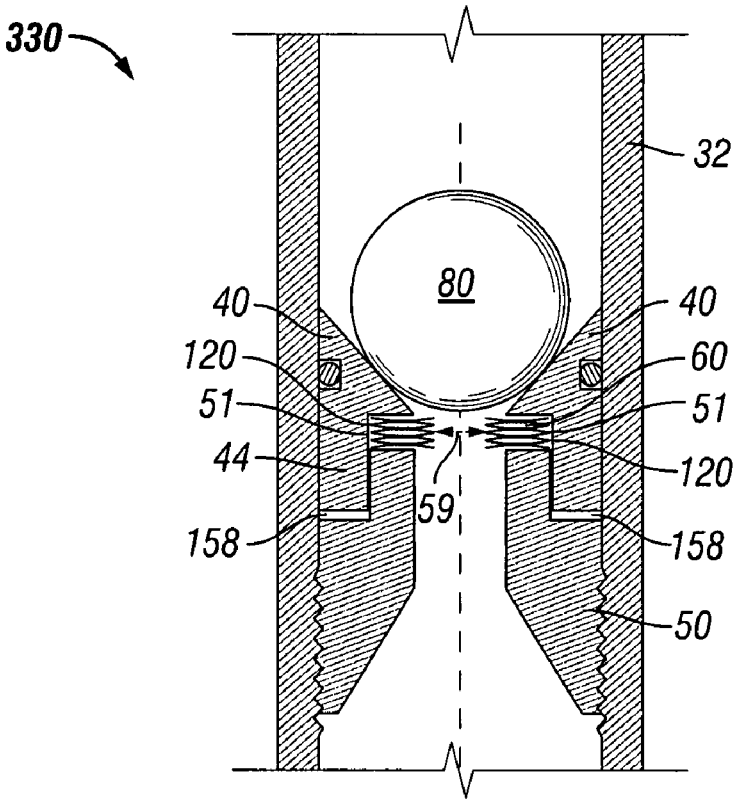
FIG. 8 is a partial cross-sectional view of the ball seat shown in FIG. 7 shown in the actuated position.

Stop member 44 is disposed outside of collet fingers 52 to form chamber 58. Return member 60 which is shown in FIGS. 1-6 and 9-10 as an upwardly biased coiled spring, is disposed within chamber 58. Although return member 60 is shown as an upwardly biased coiled spring, return member 60 may be one or more elastomer or rubber element, belleville spring (also known as belleville washers as shown in FIGS. 7-8), or any other return device, element, or member known to persons of ordinary skill in the art. Return member 60 facilitates movement of slidable element 40 and, thus, seat 38 from its set position (FIG. 2) back to the run-in position (FIG. 1) when plug element 80 is no longer being forced into seat 38.

The inner wall surfaces of slidable element 40 and collet fingers 52 define a seat bore having a seat inner diameter. A portion of the seat inner diameter is variable. Thus, in the run-in position (FIG. 1), this portion of the seat inner diameter is referred to as the first seat inner diameter 48 and, in the set-position, this portion of the seat inner diameter is referred to as the second seat inner diameter 59 (FIG. 2). First seat inner diameter 48 is greater than second seat inner diameter. In the embodiment shown in FIGS. 1-2, the variable portion of the seat inner diameter is defined by collet fingers 52.

Referring now with particular reference to FIG. 2, plug element 80 is disposed on seat 38 by engaging plug element 80 with plug element engagement surface 42. As fluid pressure is exerted downward onto plug element 80, slidable element 40 is forced downward, compressing return member 60 against retainer wall surface 56 until stop member 44 contacts retainer wall surface 56. As slidable element 40 moves downward, collet fingers 52 are forced inward toward axis 36 until collet profile surfaces 54 engage slidable element profile surfaces 46. Due to collet fingers 52 being forced inward, the seat inner diameter decreases from first seat inner diameter 48 (FIG. 1) to second seat inner diameter 59 (FIG. 2), thereby providing greater support to plug element 80. As shown in FIG. 2, collet fingers 52 are not required to contact plug element 80; however, as pressure above plug element 80 increases, plug element 80 may begin to deform and be extruded through seat inner diameter 59. As plug element 80 deforms and is extruded through seat inner diameter 59, plug element 80 may contact with, and be additionally supported by, collet fingers 52.

After the pressure forcing plug element 80 into plug element engagement surface 42 dissipates, the energized return member 60 forces slidable element 40 from the set position toward the run-in position. As a result, the portion of the seat inner diameter defined by collet fingers 52 is returned from the second seat inner diameter 59 toward the first seat inner diameter 48. It is to be understood, however, that the seat inner diameter defined by collet fingers 52 is not required to return all the way back to the first seat inner diameter 48.

Figure 3:
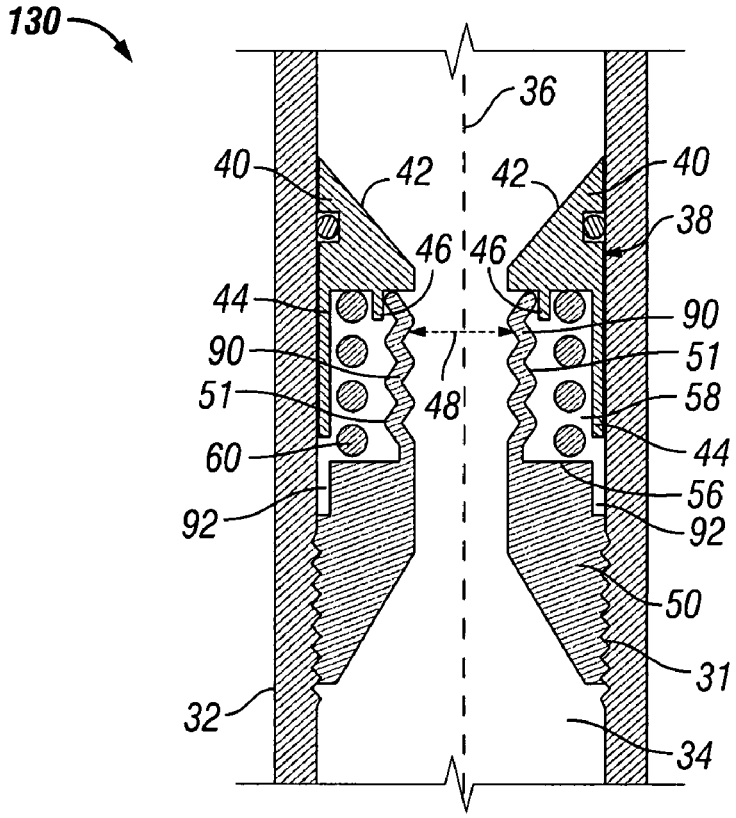
FIG. 3 is a cross-sectional view of another specific embodiment of a ball seat disclosed herein shown in the run-in position.
Figure 4:
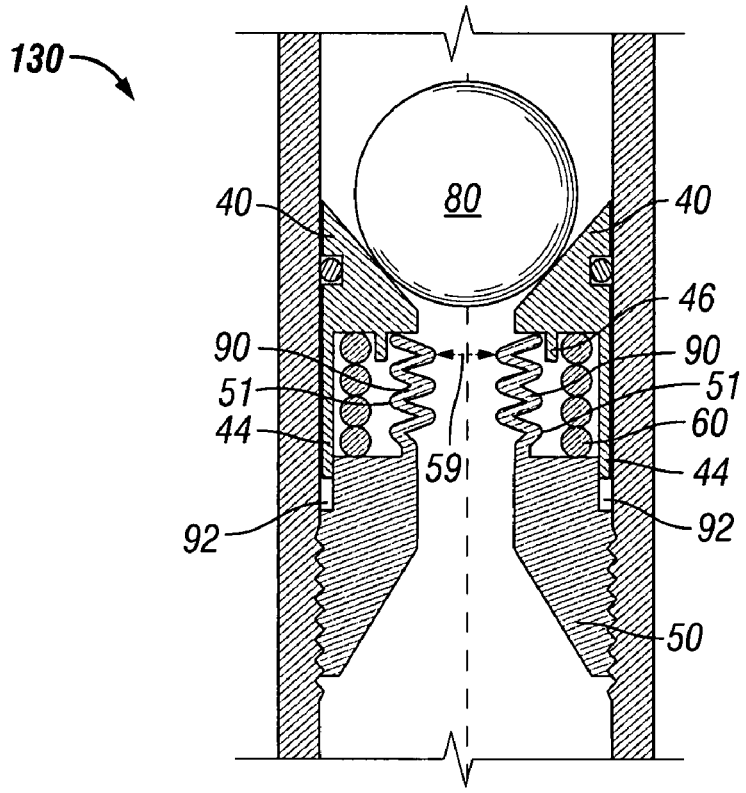
FIG. 4 is a partial cross-sectional view of the ball seat shown in FIG. 3 shown in the actuated or set position.

Referring now to FIGS. 3-4, in another embodiment ball seat 130 includes many of the structures and components discussed above with respect to FIGS. 1-2 and, thus, those structures and components are referred to with like numerals. The embodiment of FIGS. 3-4, however, includes a plug element support member 51 that is a bellows 90 operatively associated with slidable element 40 and fixed element 50 includes recess 92 for receiving stop member 44. As shown in FIGS. 3-4, profile surface 46 is disposed on a tab. Additionally, profile surface 46 forms a right angle with a lower surface of slidable element 40. Profile surface 46 maintains bellows 90 against slidable element 40 so that bellows 90 can be compressed and expanded laterally, e.g., inwardly, when slidable element 40 moves from the run-in position (FIG. 3) to the set position (FIG. 4).

As slidable element 40 is moved from the run-in position (FIG. 3) to the set position (FIG. 4), bellows 90 is compressed causing a portion of bellows 90 to extend inwardly toward axis 36. Therefore, the variable portion of the seat inner diameter is defined by bellows 90. As a result of the compression, e.g., lateral expansion or extension, of bellows 90, additional support is provided to plug element 80 by allowing distribution of the force acting upon plug element 80 to be distributed through a larger area, i.e., the cross-sectional area of bellows 90. Thus, greater force can be exerted on plug element 80 without plug element 80 or seat 38 failing.

As with the embodiment shown in FIGS. 1-2, the embodiment of FIGS. 3-4 includes a return member 60 that is energized when slidable element 40 is moved from the run-in position (FIG. 3) to the set position (FIG. 4). Accordingly, when the pressure forcing plug element 80 dissipates, return member 60 forces slidable element 40 from the set position to the run-in position. As a result, the portion of the seat inner diameter defined by bellows 90 is returned to the first seat inner diameter 48.

Figure 5:
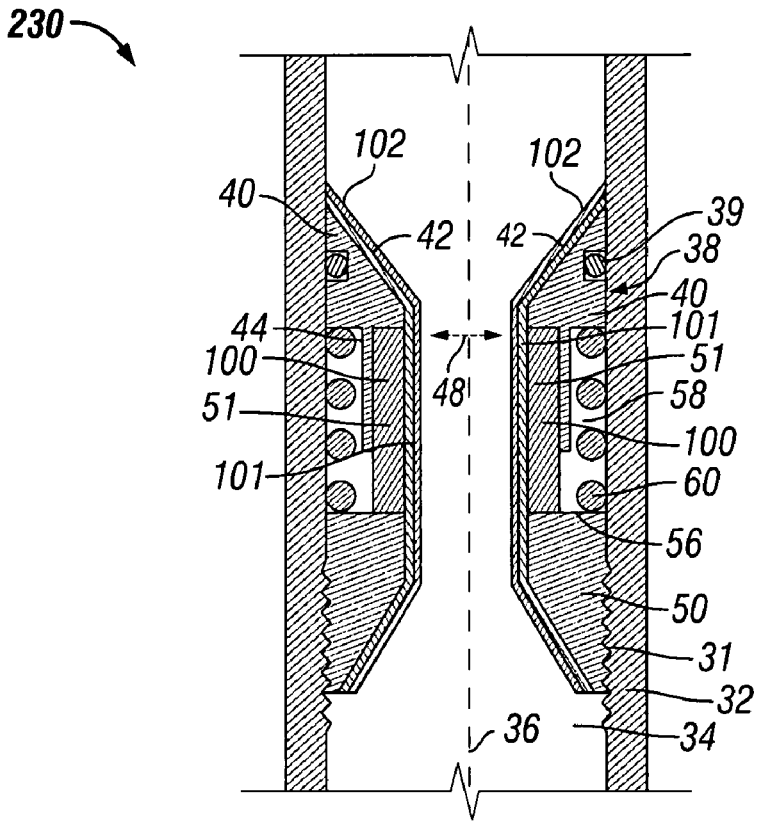
FIG. 5 is a cross-sectional view of an additional specific embodiment of a ball seat disclosed herein shown in the run-in position.
Figure 6:
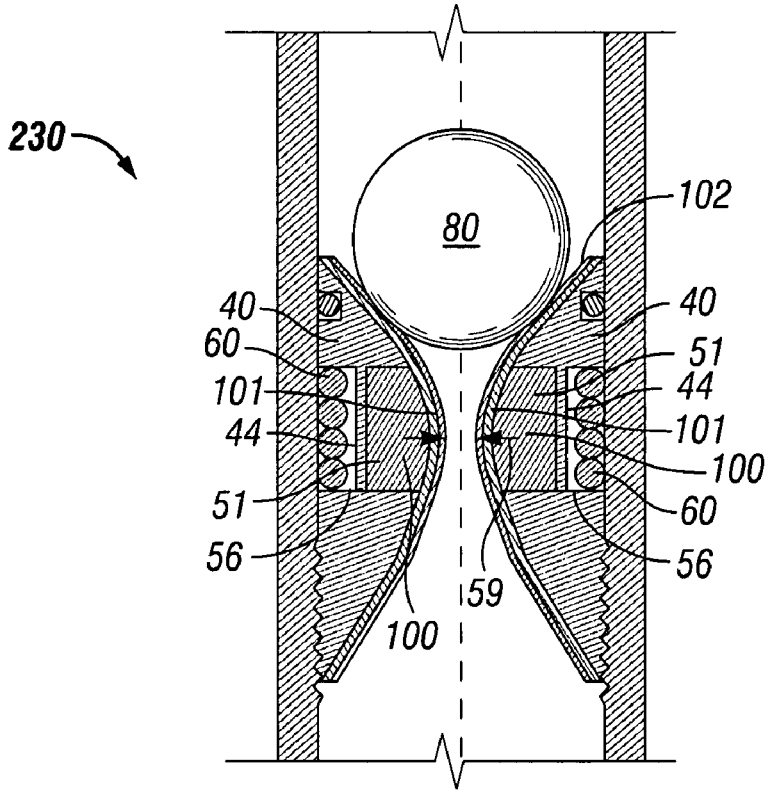
FIG. 6 is a partial cross-sectional view of the ball seat shown in FIG. 5 shown in the actuated position.

In an additional embodiment illustrated in FIGS. 5-6, ball seat 230 includes many of the structures and components discussed above with respect to FIGS. 1-4 and, thus, those structures and components are referred to with like numerals. In addition, plug element support member 51 comprises deformable element 100 disposed in chamber 58; deformable inner wall 101, and layer 102 disposed on plug element engagement surface 42 and along inner wall 101. Inner wall 101 may be a single element or may be formed by a plurality of ribs. Inner wall 101 is in sliding engagement with slidable element 40 and is affixed to slidable element 40 at the uppermost end of slidable element 40. Inner wall 101 is affixed to fixed element 50 at the lowermost end of fixed element 40. Layer 102 is affixed to inner wall 101 at the uppermost and lowermost ends of inner wall 101 so that layer 102 can expand inwardly with inner wall 101 as discussed in greater detail below.

Deformable element 100 defines a variable portion of the seat inner diameter such that lateral extension or expansion of deformable element 100, such as by compression, causes inner wall 101 of seat 38 to extend inwardly toward axis 36 as slidable element 40 moves from the run-in position (FIG. 5) to the set position (FIG. 6). Due to inner wall 101 and/or deformable element 100 being expanded laterally, a portion of the seat inner diameter is reduced from the first seat inner diameter 48 to the second seat inner diameter 59.

Deformable element 100 may be formed, in whole or in part, from one or more elastomer, polymer, or other deformable material that will change shape as slidable element 40 moves from the run-in position (FIG. 5) to the set position (FIG. 6) and extend laterally, e.g., inwardly into the seat bore to reduce the seat inner diameter from first seat inner diameter 48 to second seat inner diameter 59. Suitable deformable materials include, but are not limited to nitrile, carboxylated nitrile, hydrogenated nitrile butyl rubber, AFLAS® fluoropolymers and fluoroelastomers such as those available from AGC Chemicals America, Inc. located in Bayonne, N.J., EPDM, viton, lead, and steel wool mesh Layer 102 may be a rubber or polymer or elastomer coating layer formed from the same material as deformable element 100 to facilitate plug element 170 engaging with seat 144. Alternatively, layer 102 may be a non-slip coating applied to plug element engagement surface 42. In the embodiment shown in FIGS. 5-6, layer 102 is an elastomer or polymer that facilitates creation of a sealing engagement between plug element engagement surface 42 and plug element 80 (FIG. 2) as well as creation of a sealing engagement between plug element support members 51.

Inner wall 101 may be formed of any material capable of bending inwardly as described above. Suitable materials for inner wall 101 include steel, annealed steel, work hardenable steel, aluminum, copper, and lead.

In the embodiments in which plug element engagement surface 42 includes layer 102, layer 102 may include a shape reciprocal to the shape of the plug element when seat 38 is in the set position. As shown in FIG. 6, plug element 80 is a ball having a spherical shape and layer 102 is deformed to have a reciprocal arc shape. As mentioned above, however, although plug element 80 is shown as a ball in FIG. 2, it is to be understood that plug element 80 may be a drop plug, dart, or any other plug element known to persons of ordinary skill in the art.

Although the embodiment shown in FIGS. 5-6 includes layer 102, it is to be understood that layer 102 is not required. Thus, other embodiments based upon the embodiment illustrated in FIGS. 5-6 may have a plug element support member 51 comprising deformable element 100 and inner wall 101. Moreover, it is to be understood that inner wall 101 also may be omitted so that only deformable material 100 is extended inwardly toward axis 36 to provide additional support to plug element 80. Further, layers 102 may engage one another and, in one particular embodiment, compress into one another, so that second seat inner diameter 59 has a measurement of 0.

In an alternatively embodiment (not shown), ball seat 230 can have slidable element 40 and fixed element 50 as an integral, or whole, structure. In other words, slidable element 40 and fixed element 50 are a single structure connected by inner wall 101.

Similarly to the embodiments discussed above with respect to FIGS. 1-4, deformable material 100 of ball seat 230 provides additional support to plug element 80 due to deformable material 100 being extended or expanded laterally, e.g., inwardly toward axis 36 so that the force acting upon plug element 80 is distributed through a larger area. As also with the embodiments shown in FIGS. 1-4, ball seat 230 includes a return member 60 that is energized when slidable element 40 is moved from the run-in position (FIG. 5) to the set position (FIG. 6). Accordingly, when the pressure forcing plug element 80 into plug element engagement surface 42 dissipates, return member 60 forces slidable element 40 from the set position to the run-in position. As a result, the portion of the seat inner diameter defined by deformable element 100 is returned to the first seat inner diameter 48.

Referring now to FIGS. 7-8, in another embodiment ball seat 330 includes many of the structures and components discussed above with respect to FIGS. 1-6 and, thus, those structures and components are referred to with like numerals. In addition, ball seat 330 comprises plug element support member 51 as being belleville spring 120 (also known as belleville washers). In this embodiment, belleville spring 120 functions also as return member 60. Slidable element 40 includes stop member 44 in sliding engagement with a recess or groove 158 formed by fixed element 50. As slidable element 40 is moved from the run-in position (FIG. 7) to the set position (FIG. 8), stop member 44 slides within recess 158 toward retainer wall surface 56. In so doing, belleville spring 120 is compressed and extended laterally, e.g., inwardly toward axis 36. As a result, a portion of the seat inner diameter defined by belleville spring 120 is reduced from first seat inner diameter 48 to second seat inner diameter 59. Due to the lateral extension of belleville spring 120, additional support is provided to plug element 80 in the same manner as discussed above with respect to the other embodiments.

Also similar to the previously discussed embodiments, return member 60, i.e., belleville spring 120 in the embodiment of FIGS. 7-8, is energized when slidable element 40 is moved from the run-in position (FIG. 7) to the set position (FIG. 8). Accordingly, when the pressure forcing plug element 80 into plug element engagement surface 42 dissipates, return member 60, i.e., belleville spring 120, forces slidable element 40 from the set position to the run-in position. As a result, the seat inner diameter is returned to the first seat inner diameter 48.

Figure 9:
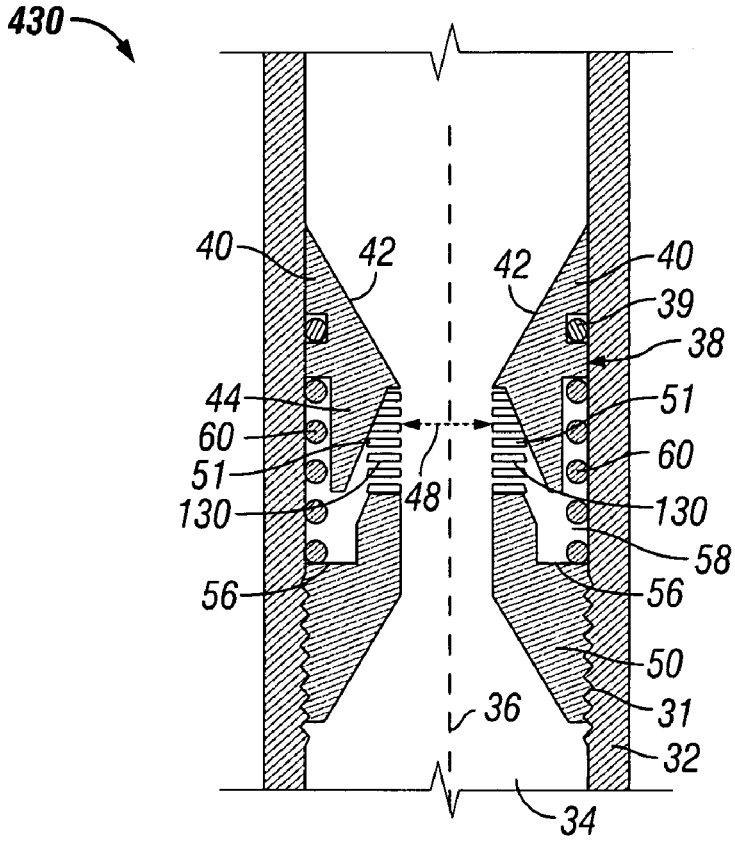
FIG. 9 is a cross-sectional view of still another specific embodiment of a ball seat disclosed herein shown in the run-in position.
Figure 10:
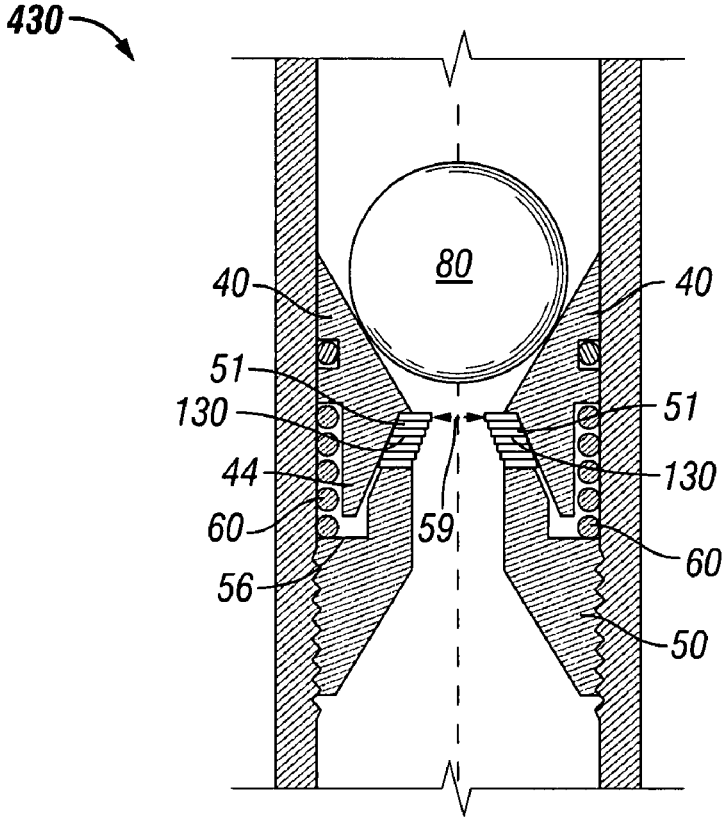
FIG. 10 is a partial cross-sectional view of the ball seat shown in FIG. 9 shown in the actuated position.

With respect to FIGS. 9-10, in another embodiment ball seat 430 includes spiral spring 130 as plug element support member 51. As slidable element 40 moves from the run-in position (FIG. 9) to the set position (FIG. 10), return member 60 and spiral spring 130 are compressed or energized. As a result of spiral spring 130 being compressed, a portion of spiral spring 130 is extended laterally and, in particular, extended inwardly toward axis 36, causing a portion of the seat inner diameter defined by spiral spring 130 to be reduced from first seat inner diameter 48 to second seat inner diameter 59. Due to the lateral expansion or extension of spiral spring 130, additional support is provided to plug element 80 in the same manner as discussed above with respect to the other embodiments.

Further, similar to the other embodiments, energizing return member 60 by moving slidable element 40 from the run-in position (FIG. 9) to the set position (FIG. 10) permits return member 60 to be able to force slidable element 40 from the set position to the run-in position when the pressure forcing plug element 80 into plug element engagement surface 42 dissipates. As a result, the portion of the seat inner diameter defined by spiral spring 130 can be returned to the first seat inner diameter 48.

In one operation of the embodiments discussed above, a ball seat is disposed in a string of conduit with a downhole tool (not shown), such as a packer or a bridge plug located above the ball seat. The string of conduit is run-in a wellbore until the string is located in the desired position. Plug element 80 is dropped down the string of conduit and landed on plug element engagement surface 42 of seat 38. Fluid, such as hydraulic fluid, is pumped down the string of conduit causing downward force or pressure to act on plug element 80. When the pressure or downward force of the fluid above seat 38 reaches a certain, usually predetermined, pressure, slidable element 40 is move from its first or run-in position (FIGS. 1, 3, 5, 7, 9) to its second or set position (FIGS. 2, 4, 6, 8, 10). As a result, return member 60 is energized, e.g., compressed.

As the pressure of the fluid increases against plug element 80 and, thus, slidable element 40 moves toward its set position, plug element support member 51 is forced laterally, e.g., inwardly, from the retracted position (FIGS. 1, 3, 5, 7, 9) toward axis 36 of the ball seats to the extended position (FIGS. 2, 4, 6, 8, 10). In one particular embodiment, plug element support member 51 engages and supports plug element 80. In other embodiments, plug element support member 51 does not directly engage or otherwise directly contact plug element 51. Instead, plug element support member 51 provides indirect support to plug element 80 through another structure in contact or engagement with plug element 80, e.g., slidable element 40.

In the embodiments shown in FIGS. 1-10, slidable element 40 slides along the housing inner wall surface causing movement of plug element support member 51 downward and inward toward axis 36 so that plug element support member 51 distributes the force acting on plug element 80 through a larger area than the contact area between plug element engagement surface 42 and plug element 80. Thus, the amount of support of plug element 80 is increased.

After actuation of a downhole tool by the increased pressure of the fluid above plug element 80 or after the increased pressure of the fluid above plug element 80 has been used for its intended purpose, fluid is no longer pumped down the string of conduit. As a result, the downward force caused by the pressurization of the fluid above plug element 80 decreases until the upward force of return member 60, either alone or in combination with hydrostatic pressure below plug element 80, overcomes the downward force of the fluid above plug element 80. Due to the upward force on plug element 80 overcoming the downward force on plug element 80, slidable element 40 and plug element 80 are forced upward which, in turn, allows plug element support member 51 to move from the extended position (FIGS. 2, 4, 6, 8, 10) to the retracted position (FIGS. 1, 3, 5, 7, 9). In so doing, the seat inner diameter is returned from second inner seat diameter 59 to first seat inner diameter 48.

Plug element 80 can be removed through methods and using devices known to persons of ordinary skill in the art, e.g., milling, dissolving, or fragmenting plug element 80. Alternatively, plug element 80 may be a lightweight "float" plug element such that, when pressure is reduced, plug element 80 is permitted to float up to the top of the well. After plug element 80 is removed and plug element support member 51 is returned to its retracted position (FIGS. 1, 3, 5, 7, 9), the ball seats can be reused by disposing a second plug element on seat 38 in the same manner as discussed above.

It is to be understood that the invention is not limited to the exact details of construction, operation, exact materials, or embodiments shown and described, as modifications and equivalents will be apparent to one skilled in the art. For example, the size of each plug element support member can be any size or shape desired or necessary to be moved from the retracted position to the extended position to provide support to the plug element. Further, the size and shape of slidable element and fixed element can be any size or shaped desired or necessary to facilitate extension of the plug element support member into the seat inner diameter to restrict the seat inner diameter and permit the force acting on the plug element to be distributed through a larger force distribution area compared to the engagement of the seat with the plug element.

Additionally, although the apparatuses described in greater detail with respect to FIGS. 1-10 are ball seats having a ball as their respective plug elements, it is to be understood that the apparatuses disclosed herein may be any type of seat known to persons of ordinary skill in the art that include at least one plug element support member. For example, the apparatus may be a drop plug seat, wherein the drop plug temporarily restricts the flow of fluid through the wellbore. Therefore, the term "plug" as used herein encompasses a ball as shown in FIGS. 1-10, as well as any other type of device that is used to restrict the flow of fluid through a ball seat. Further, in all of the embodiments discussed with respect to FIGS. 1-10, upward, toward the surface of the well (not shown), is toward the top of FIGS. 1-10, and downward or downhole (the direction going away from the surface of the well) is toward the bottom of FIGS. 1-10. However, it is to be understood that the ball seats may have their positions rotated. Accordingly, the ball seats can be used in any number of orientations easily determinable and adaptable to persons of ordinary skill in the art. Accordingly, the invention is therefore to be limited only by the scope of the appended claims.

What is claimed is:

1. An apparatus for restricting flow through a well conduit, the apparatus comprising:

a housing having a longitudinal bore having an axis and a seat disposed within the bore, the seat comprising a slidable element in sliding engagement with an inner wall surface of the housing, the slidable element having a run-in position and a set position, the seat further comprising an engagement surface for receiving a plug element, and a fixed element secured to the housing, the fixed element being operatively associated with the element;

a plug element support member operatively associated with the slidable element and the fixed element, the plug element support member having a retracted position defining a first seat inner diameter and an extended position defining a second seat inner diameter, the first seat inner diameter being greater than the second seat inner diameter, the plug element support member being disposed below the seat; and a return member operatively associated with the slidable element for urging the slidable element toward the run-in position, wherein the plug element support member is in the retracted position when the seat is in the run-in position and the plug element support member is in the extended position when the seat is in the set position, the plug element support member restricting the bore when in the extended position, and wherein the plug element is adapted to be disposed into the bore and landed on the seat engagement surface to restrict fluid flow through the bore and the well conduit and to cause the plug element support member to move from the retracted position to the extended position so that the plug element support member restricts the bore and provides support to the plug element landed on the seat engagement surface.

2. The apparatus of claim 1, wherein the plug element support member is a deformable element.

3. The apparatus of claim 2, wherein the slidable portion is connected to the fixed portion by a seat inner wall, the seat inner wall partially defining a chamber.

4. The apparatus of claim 3, wherein the deformable element is disposed within the chamber.

5. The apparatus of claim 1, wherein the plug element support member is a collet.

6. The apparatus of claim 5, wherein the collet includes a plurality of collet fingers, each collet finger having a collet profile surface reciprocal in shape to a slidable element profile surface disposed on the slidable element.

7. The apparatus of claim 1, wherein the plug element support member is a spiral spring.

8. The apparatus of claim 1, wherein the seat comprises a plug element engagement surface, the plug element engagement surface having a deformable layer capable of forming a shape reciprocal to a shape of the plug element.

9. The apparatus of claim 1, wherein the plug element support member is a bellows.

10. The apparatus of claim 1, wherein the plug element support member is a belleville spring.

11. The apparatus of claim 1, wherein the plug element support member and the return member are the same belleville spring.

12. An apparatus for restricting flow through a well conduit, the apparatus having a run-in position and a set position, the apparatus comprising:

a housing having a longitudinal bore with a seat engagement surface disposed on an inner wall surface of the bore;

a seat comprising a slidable element, the slidable element in sliding engagement with the seat engagement surface and having a first position when the apparatus is in the run-in position and a second position when the apparatus is in the set position, the seat further comprising an engagement surface for receiving a plug element, and a fixed element secured to the housing, the fixed element being operatively associated with the slidable element; and a plug element support member operatively associated with the slidable element and the fixed element, the plug element support member having a retracted position when the apparatus is in the run-in position and an extended position when the apparatus is in the set position, the retracted position defining a first plug element support member cross-sectional area and the extended position defining a second plug element support member cross-sectional area, the second plug element support member cross-sectional area being greater than the first plug element support member cross-sectional area, the plug element support member being disposed below the seat,; and wherein the plug element is adapted to be disposed into the bore and landed on the seat engagement surface to restrict fluid flow through the bore and the well conduit and to cause the plug element support member to move from the retracted position to the extended position thereby defining the second plug element support member cross-sectional area and providing support to the plug element landed on the seat engagement surface, and wherein the plug element support member extends laterally in the extended position to define the second plug element support member cross-sectional area and to distribute across the second plug element support member cross-sectional area a pressure forcing the plug element into the seat engagement surface.

13. The apparatus of claim 12, wherein the plug element support member is a deformable element.

14. The apparatus of claim 12, wherein the plug element support member is a collet.

15. The apparatus of claim 12, wherein the plug element support member is a spiral spring.

16. The apparatus of claim 12, wherein the plug element support member is a bellows.

17. The apparatus of claim 12, wherein the plug element support member is a belleville spring.

18. A method of temporarily restricting a well conduit, the method comprising the steps of:

(a) providing a seat disposed within a housing having a longitudinal bore, the seat comprising a slidable element, the slidable element in sliding engagement with an inner wall surface of the housing and having a first position and a second position when the apparatus is in the set position, the slidable element having a plug member engagement surface for receiving a plug element, a fixed element secured to the housing, the fixed element being operatively associated with the slidable element, a plug element support member operatively associated with the slidable element and the fixed element, the plug element support member having a retracted position when the slidable element is in the first position and an extended position when the slidable element is in the second position, the plug element support member being disposed below the plug member engagement surface, and a return member operatively associated with the slidable element for urging the slidable element toward the first position;

(b) lowering the seat on a string of conduit into a wellbore of a well;

(c) restricting the bore and well conduit by inserting the plug element into the conduit and landing the plug element on the plug element engagement surface of the slidable element;

(d) moving the slidable element from the first position to the second position by exerting a force on the slidable element;

(e) as a result of step (d), moving the plug element support member from a retracted position to an extended position in which the plug element support member restricts the bore and provides support to the plug element engagement surface, thereby distributing a portion of the force exerted on the slidable element to the plug element support member;

(f) pumping fluid into the conduit forcing the plug element into the seat and energizing the return member;

(g) reducing the pumping of fluid into the conduit to allow the return member to urge the slidable element from the second position to the first position;

(h) removing the plug element from the slidable element; and (i) moving the slidable element toward the first position and the plug element support member toward the retracted position.

19. The method of claim 18, wherein steps (c)-(f) are repeated.

20. The method of claim 18, wherein a downhole tool is actuated as a result of pumping fluid into the conduit forcing the plug element into the seat and energizing the return member.

21. An apparatus for restricting flow through a well conduit, the apparatus comprising:

a housing having a longitudinal bore having an axis and a seat disposed within the bore, the seat comprising a slidable element in sliding engagement with an inner wall surface of the housing, the slidable element having a run-in position and a set position, a fixed element secured to the housing, the fixed element being operatively associated with the slidable element, a plug element support member operatively associated with the slidable element and the fixed element, the plug element support member having a retracted position defining a first seat inner diameter and an extended position defining a second seat inner diameter, the first seat inner diameter being greater than the second seat inner diameter, and a return member operatively associated with the slidable element for urging the slidable element toward the run-in position, wherein the plug element support member is in the retracted position when the seat is in the run-in position and the plug element support member is in the extended position when the seat is in the set position, the plug element support member restricting the bore when in the extended position; and a plug element adapted to be disposed into the bore and landed on the seat to restrict fluid flow through the bore and the well conduit and to cause the plug element support member to move from the retracted position to the extended position thereby restricting the bore and providing support to the plug element landed on the seat, wherein the plug element support member is a deformable element, wherein the slidable portion is connected to the fixed portion by a seat inner wall, the seat inner wall partially defining a chamber, and wherein the deformable element is disposed within the chamber.

22. An apparatus for restricting flow through a well conduit, the apparatus comprising:

a housing having a longitudinal bore having an axis and a seat disposed within the bore, the seat comprising a slidable element in sliding engagement with an inner wall surface of the housing, the slidable element having a run-in position and a set position, a fixed element secured to the housing, the fixed element being operatively associated with the slidable element, a plug element support member operatively associated with the slidable element and the fixed element, the plug element support member having a retracted position defining a first seat inner diameter and an extended position defining a second seat inner diameter, the first seat inner diameter being greater than the second seat inner diameter, and a return member operatively associated with the slidable element for urging the slidable element toward the run-in position, wherein the plug element support member is in the retracted position when the seat is in the run-in position and the plug element support member is in the extended position when the seat is in the set position, the plug element support member restricting the bore when in the extended position; and a plug element adapted to be disposed into the bore and landed on the seat to restrict fluid flow through the bore and the well conduit and to cause the plug element support member to move from the retracted position to the extended position thereby restricting the bore and providing support to the plug element landed on the seat, wherein the plug element support member and the return member are the same belleville spring.

* * * * *